US010080397B2

(12) United States Patent
Kelson

(10) Patent No.: US 10,080,397 B2
(45) Date of Patent: Sep. 25, 2018

(54) ESTHETIC APPARATUS AND RELATED METHODS OF USE

(71) Applicant: Lash Wrap LLC, Boise, ID (US)

(72) Inventor: Malaena Kelson, Boise, ID (US)

(73) Assignee: Lash Wrap, LLC, Boise, ID (US)

( * ) Notice: Subject to any disclaimer, the term of this patent is extended or adjusted under 35 U.S.C. 154(b) by 0 days.

(21) Appl. No.: 14/884,316

(22) Filed: Oct. 15, 2015

(65) Prior Publication Data

US 2016/0106172 A1 Apr. 21, 2016

Related U.S. Application Data

(60) Provisional application No. 62/064,342, filed on Oct. 15, 2014.

(51) Int. Cl.

| | |
|---|---|
| ***A41G 5/02*** | (2006.01) |
| ***A45D 44/04*** | (2006.01) |
| ***A45F 5/00*** | (2006.01) |
| ***A45D 44/00*** | (2006.01) |
| *A41D 19/00* | (2006.01) |

(52) U.S. Cl.

CPC ..... *A41G 5/02* (2013.01); *A45D 44/00* (2013.01); *A45D 44/04* (2013.01); *A45F 5/00* (2013.01); *A41D 19/0037* (2013.01); *A45F 2005/008* (2013.01)

(58) Field of Classification Search

CPC .... A41D 13/08; A41D 13/081; A41D 13/085; A41D 19/015; A41D 2600/20; A41G 5/02; A45F 2005/008; A45F 3/14; A45F 5/00; A63B 69/0046; A63B 71/14; A63B 71/141

USPC ..... 132/216, 201; 294/25; 224/217, 218, 224/219

See application file for complete search history.

(56) References Cited

U.S. PATENT DOCUMENTS

| | | | | |
|---|---|---|---|---|
| 1,458,436 | A | 9/1921 | Pameyer | |
| 4,504,980 | A * | 3/1985 | Butcher | A41D 13/081 2/160 |
| 7,048,162 | B2 * | 5/2006 | Frye | A45D 29/20 206/373 |
| 7,222,629 | B1 * | 5/2007 | Han | A41G 5/02 132/216 |
| 7,334,711 | B1 * | 2/2008 | Winters | A45F 5/00 224/217 |
| 2006/0283719 | A1 | 12/2006 | Surabischwilil | |
| 2009/0321483 | A1 * | 12/2009 | Froloff | A45F 5/00 224/267 |

(Continued)

FOREIGN PATENT DOCUMENTS

| | | |
|---|---|---|
| WO | 2013102124 | 7/2013 |
| WO | 2016061337 | 4/2016 |

OTHER PUBLICATIONS

"Written Opinion", PCT Application No. PCT/US15/55717, dated Dec. 31, 2015, 6 pages.

*Primary Examiner* — Jennifer Gill
(74) *Attorney, Agent, or Firm* — Colby Nipper PLLC

(57) ABSTRACT

An esthetic apparatus and method for use in the application of cosmetics is disclosed herein. The esthetic apparatus includes an elongate member that can be at least partially wrapped around the hand, wrist, and/or arm of a user. A palette for holding an esthetic product can also be coupled to the esthetic apparatus.

20 Claims, 11 Drawing Sheets

(56) References Cited

U.S. PATENT DOCUMENTS

| | | | | |
|---|---|---|---|---|
| 2012/0023633 | A1* | 2/2012 | Kummerfeldt | A41D 13/081 2/16 |
| 2012/0255978 | A1* | 10/2012 | Williams | A45F 5/00 224/219 |
| 2013/0062225 | A1 | 3/2013 | Lavaque et al. | |
| 2013/0300141 | A1* | 11/2013 | Byrne | A45F 5/00 294/25 |
| 2014/0116459 | A1* | 5/2014 | McKinstry | A41G 5/02 132/216 |

* cited by examiner

ESTHETIC APPARATUS AND RELATED METHODS OF USE

RELATED APPLICATIONS

This application claims the benefit under 35 U.S.C. § 119(e) of U.S. Provisional Patent Application No. 62/064,342, filed Oct. 15, 2014, and titled "EYELASH EXTENSION APPLICATOR APPARATUS," which is hereby incorporated herein by reference in its entirety.

TECHNICAL FIELD

The present disclosure relates generally to an esthetic apparatus and related methods of use. More particularly, the present disclosure relates to an esthetic apparatus for use in the application of eyelash extensions.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

Many people throughout the world use esthetic products to improve their appearances. Some esthetic products are simple and able to be self-applied. However, other types of esthetic products are difficult to self-apply, and the person may be better served by having an esthetician assist in the application of the esthetic product.

Eyelash extensions are a popular esthetic product that can be difficult to apply, and many users of eyelash extensions use an esthetician to have them applied. In the application process, an esthetician generally will remove eyelash extensions from a package and place them on a tray. Some eyelash extensions come in individual eyelash pieces and others come organized in strips of eyelash pieces. The tray containing the eyelash extensions is generally placed on a table or counter and the esthetician is often forced to reach over to the table or counter to pick up an eyelash extension, dip the end of the eyelash extension in glue, and then reach back towards the eye of the person upon whom the eyelash extensions are applied. This process is inefficient, and may result in losing eyelash extensions during the esthetician's reach from the table or counter to the eye of the person.

Embodiments described herein include an esthetic apparatus, related methods, and kits for use in applying an esthetic product that allow a user (e.g., an esthetician) to secure a palette with eyelash extensions to their hand, wrist, or arm, thereby allowing the user to easily control the location of the eyelash extensions during application to the eye of their client.

Figure 1:
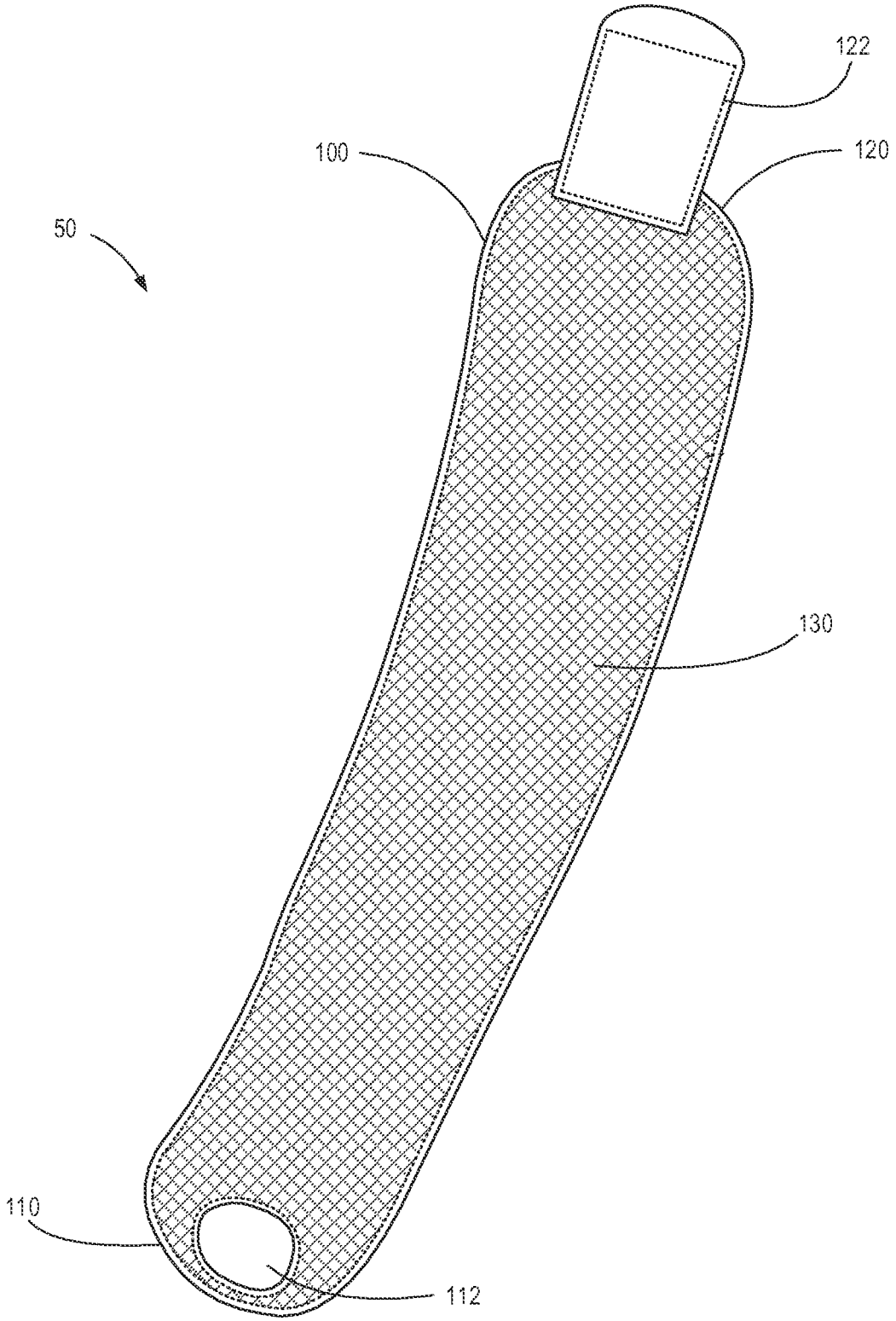
FIG. 1 is a perspective view of an esthetic apparatus in an unwrapped configuration, according to an embodiment of the present disclosure.

FIG. 1 depicts an esthetic apparatus 50 in an unwrapped configuration, according to an embodiment of the present disclosure. The esthetic apparatus 50 comprises an elongate member 100. FIG. 1 shows an external surface of the elongate member 100 that is opposite an interior surface of the elongate member 100. The esthetic apparatus 50 further comprises an aperture or digit hole 112, an attachment member 122, and a coupling region 130 comprising substantially all of the external surface.

Figure 2:
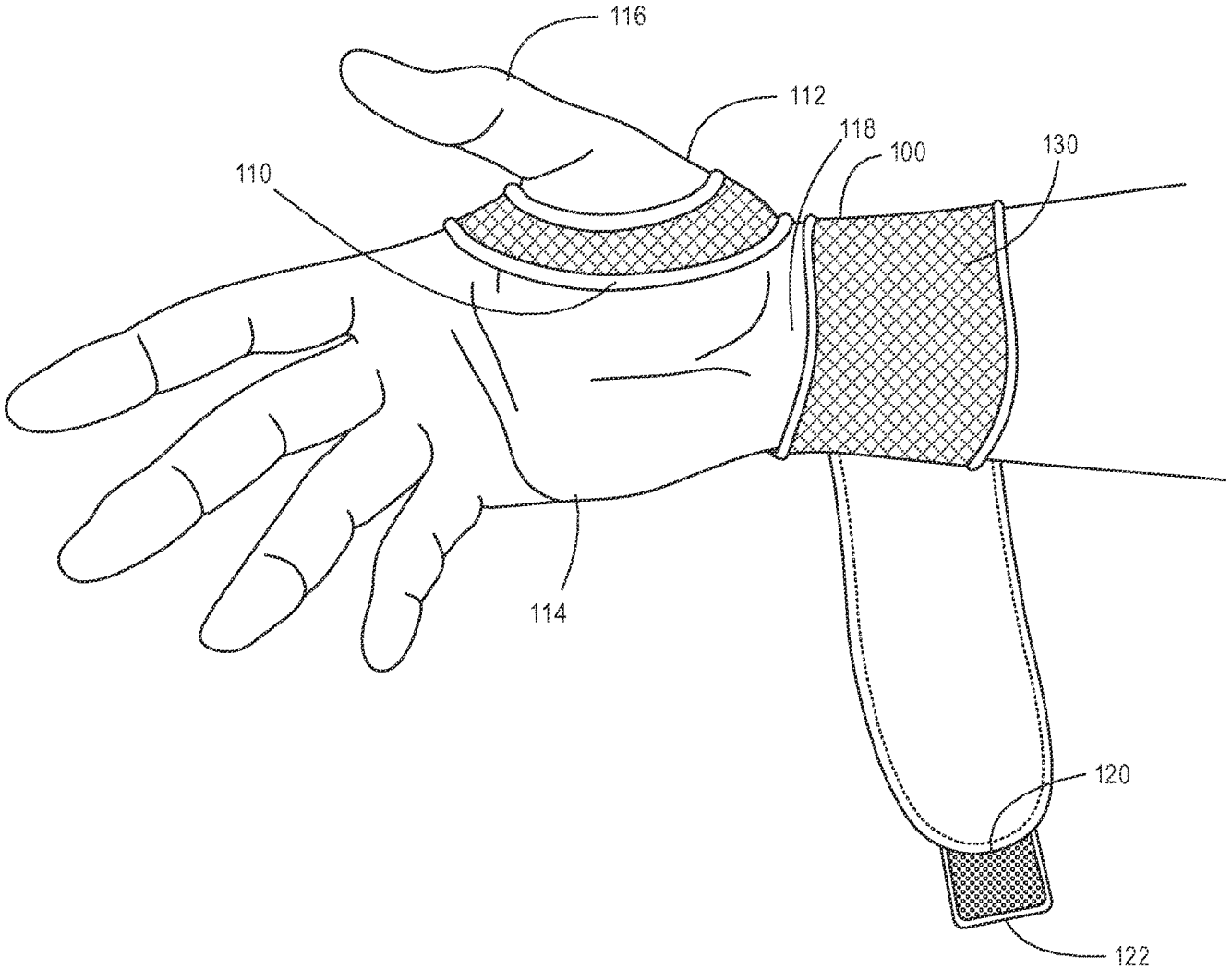
FIG. 2 is a perspective view of the esthetic apparatus of FIG. 1 in a partially wrapped configuration.
Figure 3A:
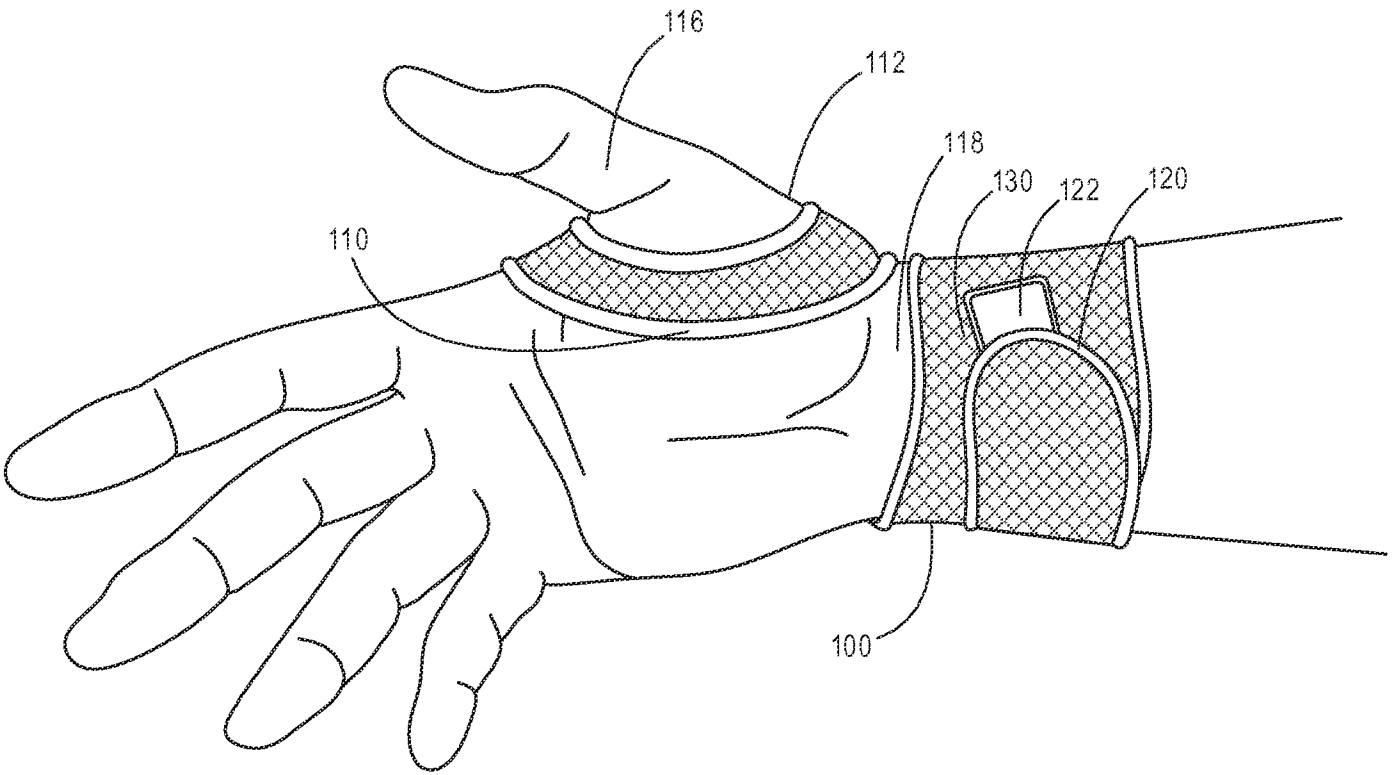
FIG. 3A is a perspective view of the esthetic apparatus of FIG. 1 in a wrapped configuration, depicting the esthetic apparatus in relation to the front or palm side of a user's hand.
Figure 3B:
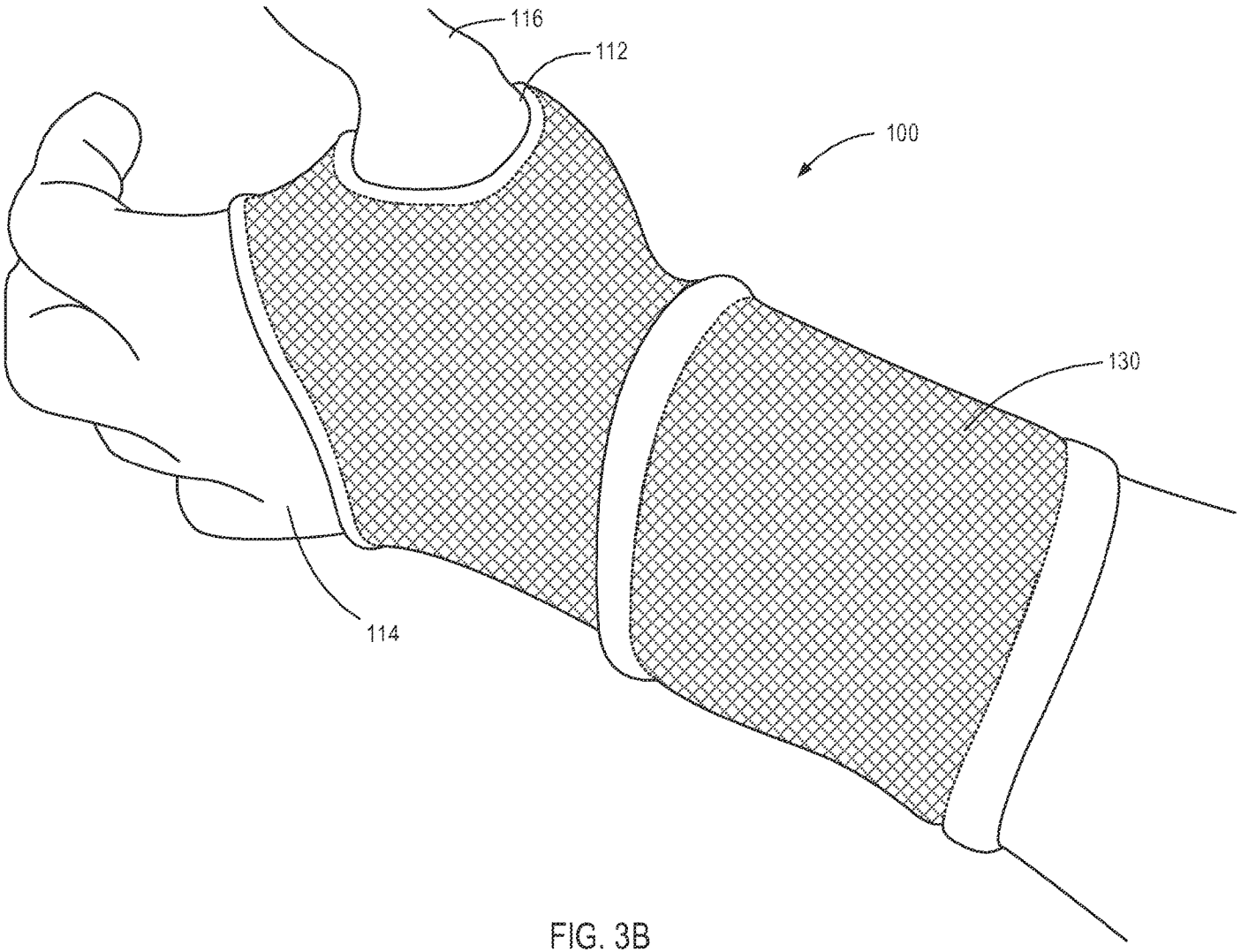
FIG. 3B is a perspective view of the esthetic apparatus of FIG. 1 in a wrapped configuration, depicting the esthetic apparatus in relation to the back side of a user's hand.

As shown in FIG. 1, the elongate member 100 comprises a first longitudinal end 110 and a second longitudinal end 120. The elongate member 100 is also configured to be wrapped around at least a portion of one or more of a user's hand, wrist, or arm, (e.g., as is shown in FIGS. 2, 3A, and 3B). The elongate member 100 can also be made of various materials, including but not limited to, nylon and various types of fabrics. In some embodiments, the materials comprise loops to be used in a hook and loop connection. The elongate member 100 can include elastic materials. The elongate member 100 can also comprise flexible or non-rigid materials, allowing the elongate member 100 to be wrapped around the user's hand, wrist, or arm in various configurations to achieve a satisfied level of comfort. For example, the elongate member 100 can be tightly (e.g., snuggly) or loosely wrapped as desired.

The aperture or digit hole 112 can be used to anchor the esthetic apparatus 50 to the user's hand. For example, the aperture or digit hole 112 can be placed over a digit (e.g., the thumb) of the user's hand prior to wrapping the esthetic apparatus 50. In one illustrative embodiment, for example, the aperture or digit hole 112 can be placed over the thumb of a user's hand after which the elongate member 100 can be wrapped such that it extends across the back side of the user's hand (opposite the palm) and around the user's wrist or arm.

Figure 8:
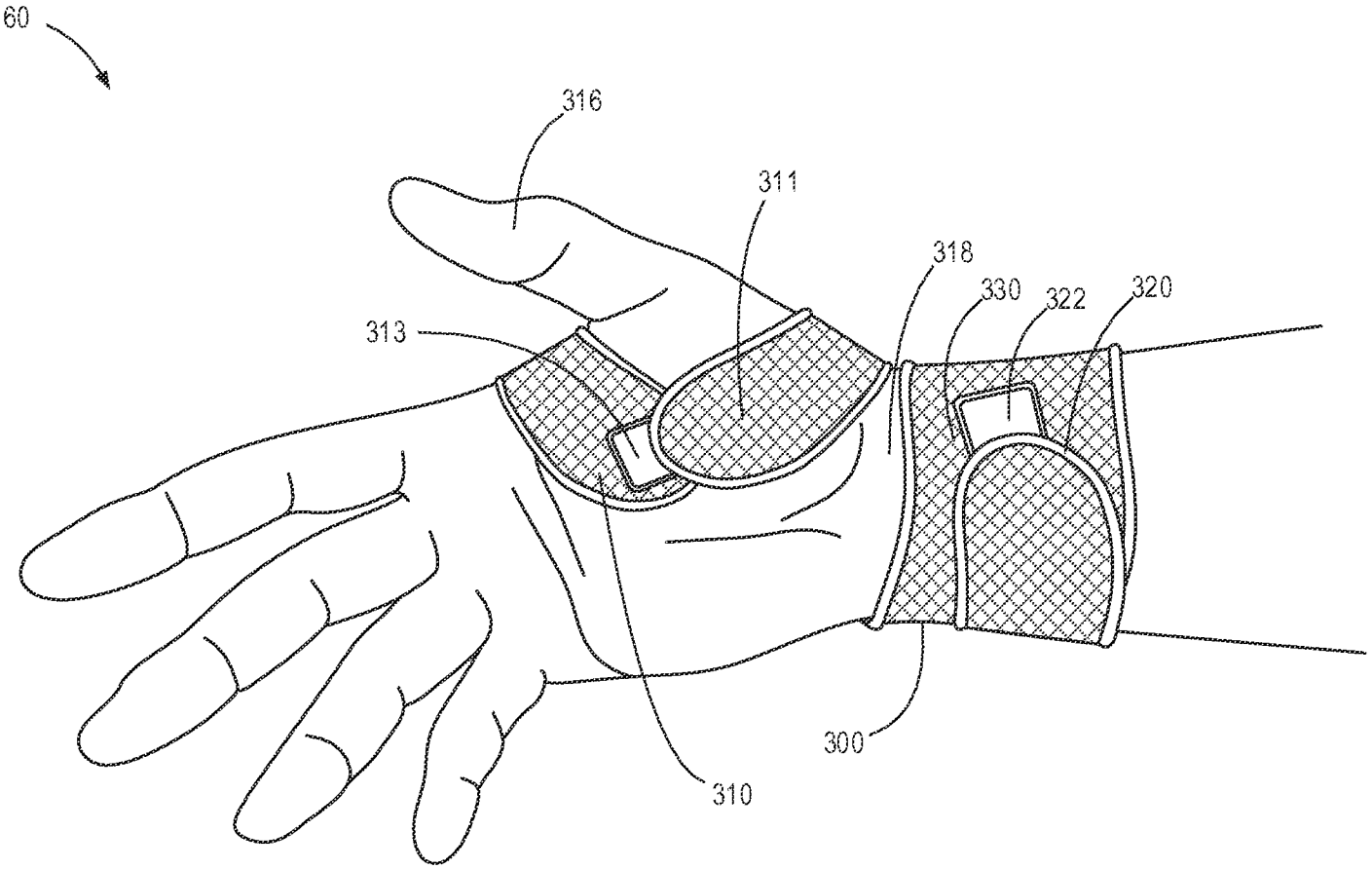
FIG. 8 is a perspective view of another esthetic apparatus in a wrapped configuration, according to another embodiment of the present disclosure.
Figure 9:
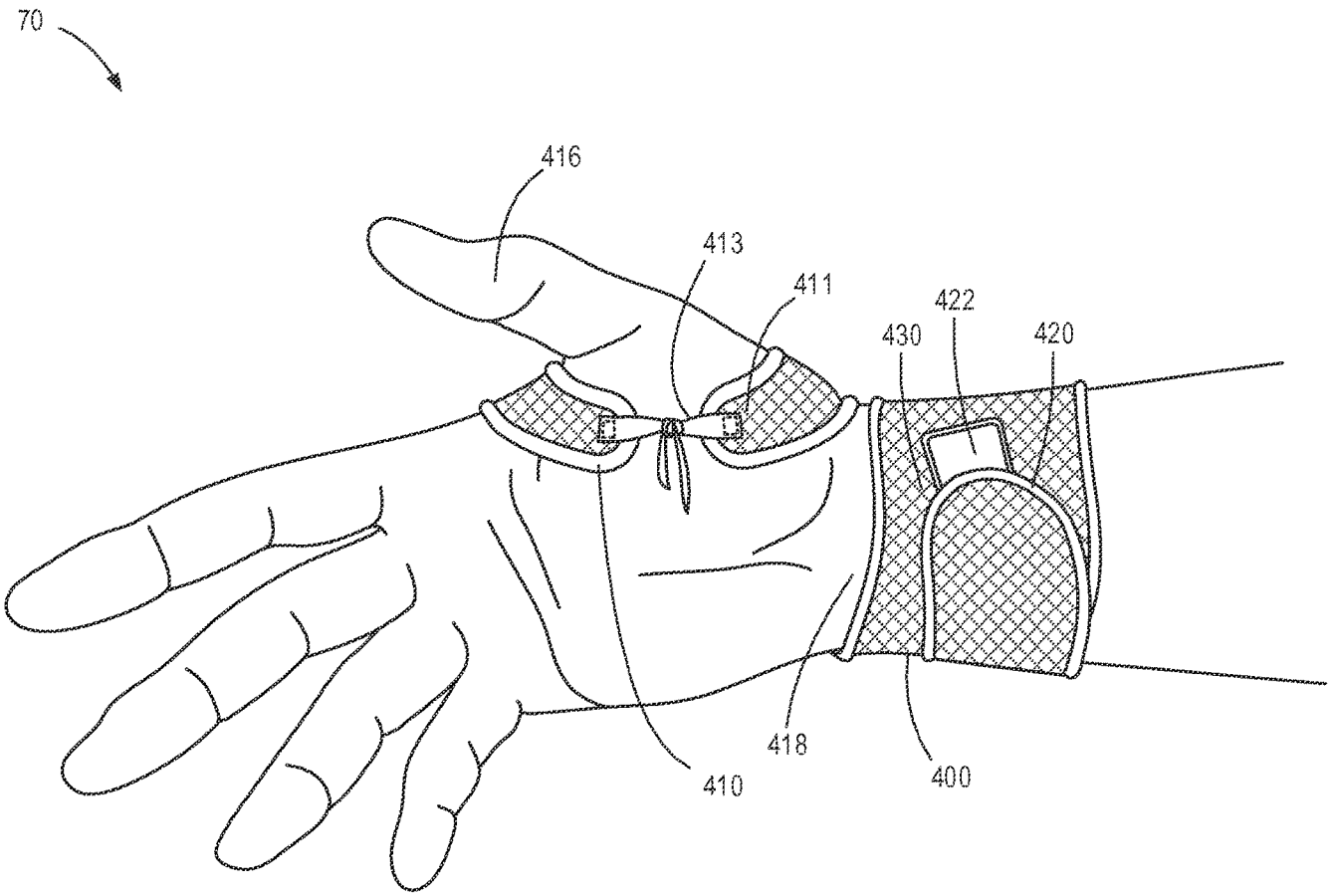
FIG. 9 is a perspective view of another esthetic apparatus in a wrapped configuration, according to another embodiment of the present disclosure.

In some embodiments, such as the illustrated embodiment of FIG. 1, the aperture or digit hole 112 comprises an opening that extends through the elongate member 100. In other embodiments, the aperture or digit hole 112 can be formed by coupling two separate segments together, such as is shown in FIGS. 8 and 9 and further detailed below. Some of such embodiments can comprise a first longitudinal end that is longitudinally divided into a plurality of segments and configured for wrapping at least two of the plurality of segments around a digit of the user's hand. These two components may be coupled together by any coupling member or attachment member described herein such as a hook and hook or hook and loop connection. In yet further embodiments, the elongate member 100 comprises a plurality of apertures or digit holes 112. The elongate member 100 can also be configured to wrap around a portion of a user's hand, wrist, or arm without utilizing an aperture or digit hole 112. In another embodiment, the elongate member 100 can be shaped via molding, forming or stitching to fit the shape of the user's hand such that an aperture or digit hole 112 need not be necessary. In still other embodiments, the elongate member 100 can comprise one or more sleeves for digits of the user's hand, (e.g., like the fingers of a glove).

After the elongate member 100 is wrapped around at least a portion of one or more of the user's hand, wrist, or arm, the attachment member 122 can be used to keep the elongate member 100 from unwrapping. For example, in the illustrated embodiment, the attachment member 122 is coupled to the second longitudinal end 120 of the elongate member 100. In such embodiments, after the elongate member 100 is wrapped around at least a portion of one or more of the user's hand, wrist, or arm, the attachment member 122 can be used to couple the second longitudinal end 120 to another portion of the elongate member 110 (e.g., a portion that is longitudinally distant or removed from the second longitudinal end 120 when viewed in the unwrapped configuration). By coupling the attachment member 122 to another portion of the elongate member 100, the esthetic apparatus 50 can be held or retained in the wrapped configuration during use. In some embodiments, the portion of the elongate member 100 to which the attachment member 122 is configured to attach can be an attachment region that is independent from the coupling region. In other embodiments, the coupling region 130 comprises the attachment region. In some of these embodiments, the majority of the surface of at least one side of the elongate member 100 consists of the coupling region 130 comprising the attachment region. As further detailed below, a portion of the coupling region 130 can also be configured to interact with, and couple to, a tool for applying esthetic products (e.g., a palette as described herein). In some embodiments of the elongate member 100, the attachment member comprises hook elements of a hook and loop connector and the attachment region comprises loop elements of the hook and loop connector.

With continued reference to FIG. 1, in some embodiments the attachment member 122 is positioned at or near the second longitudinal end 120 of the elongate member 100. In other embodiments, the attachment member 122 is positioned at a location that is between the first longitudinal end 110 and the second longitudinal end 120. The attachment member 122 can be configured to engage the coupling region 130 of the elongate member 100. The attachment member 122 can also comprise a fastener or a component of a fastener. Exemplary fasteners that can be used include, but are not limited to, clips, snaps, ties, buckles, hooks, or snaps, hook and loop fasteners, and hook and hook fasteners.

The coupling region 130 can be used to couple the attachment member 122 to the elongate member 100. For example, the coupling region 130 can comprise a surface that is complimentary to the attachment member 122. In other words, the coupling region 130 can comprise a surface or material to which the attachment member 122 can couple or otherwise attach. Similarly, the coupling region 130 can also be used to couple a palette to the elongate member 100, as further detailed below. In some embodiments, the coupling region 130 comprises a relatively large portion of the surface area of the first side of the elongate member 100. For example, a majority of the surface area of the first side of the elongate member 100 can comprise the coupling region 130. In such embodiments, the attachment member 122 can couple to the coupling region 130 at any one of plurality of sites along the elongate member 100. In other embodiments, the coupling region 130 can be constrained to a limited and/or relatively smaller surface area of the first side of the elongate member 100.

In particular embodiments, the coupling region 130 can comprise a fastener or a component of a fastener, such as a clip, snap, tie, buckle, hook, snap, hook and loop fastener, or hook and hook fastener (e.g., VELCRO®). Further, in some embodiments, the coupling region 130 and the attachment member 122 can cooperate to form an engagement, coupling, or attachment (e.g., VELCRO®). Similarly, in some embodiments, the coupling region 130 and the palette can cooperate to form an engagement, coupling, or attachment (e.g., VELCRO®).

FIG. 2 depicts the esthetic apparatus 50 of FIG. 1 in a partially wrapped configuration. In the partially wrapped configuration, the elongate member 100 is partially wrapped around at least one or more of the user's hand 114, wrist 118, or arm. For example, as shown in the illustrated embodiment, the first longitudinal end 110 is disposed on the palm side of a user's hand 114, with the user's thumb 116 being disposed through the aperture or digit hole 112. The elongate member 100 is then wrapped such that it extends along the back side of the user's hand 114 (opposite the palm side) to the front side of the user's wrist 118 and then at least partially around the user's wrist 118. At the user's discretion (e.g., after wrapping the remaining portion of the elongate member 100 around the wrist 18 or arm), the attachment member 122 can be coupled to the coupling region 130 (which can comprise at least a portion of the surface of the elongate member 100).

In other embodiments, the elongate member 100 can be wrapped in manner that is opposite to the manner depicted in FIG. 2. For example, the elongate member 100 can be anchored to one or more of the user's digits and wrapped such that it extends along the front side (e.g., the palm side) of the user's hand, around the bottom of the user's hand or wrist to the back side of the user's wrist, and then around the user's wrist. In yet other embodiments, the elongate member 100 can be configured to wrap around only the user's hand. In still other embodiments, the elongate member 100 can be configured to anchor to the user's hand using an anchoring member such as an aperture, digit hole, or rigid component formed to fit a portion of the user's hand. In such embodiments, the elongate member may be further configured to be wrapped around the user's hand and dispose a portion of the elongate member distinct from the anchoring member between the user's thumb and index finger.

FIGS. 3A and 3B depict the esthetic apparatus 50 of FIG. 1 in a wrapped configuration. More specifically, FIG. 3A depicts the esthetic apparatus 50 in a wrapped configuration in relation to the front side or palm side of the user's hand 114, and FIG. 3B depicts the esthetic apparatus 50 in relation the back side of the user's hand 114. Collectively, FIGS. 3A and 3B illustrate the elongate member 100 fully encircling at least a portion of one or more of the user's hand 114, wrist 118, or arm. Further, the coupling region 130 is available for the attachment member 122 to couple or otherwise attach to at a plurality of locations along the elongate member 100.

Figure 4:
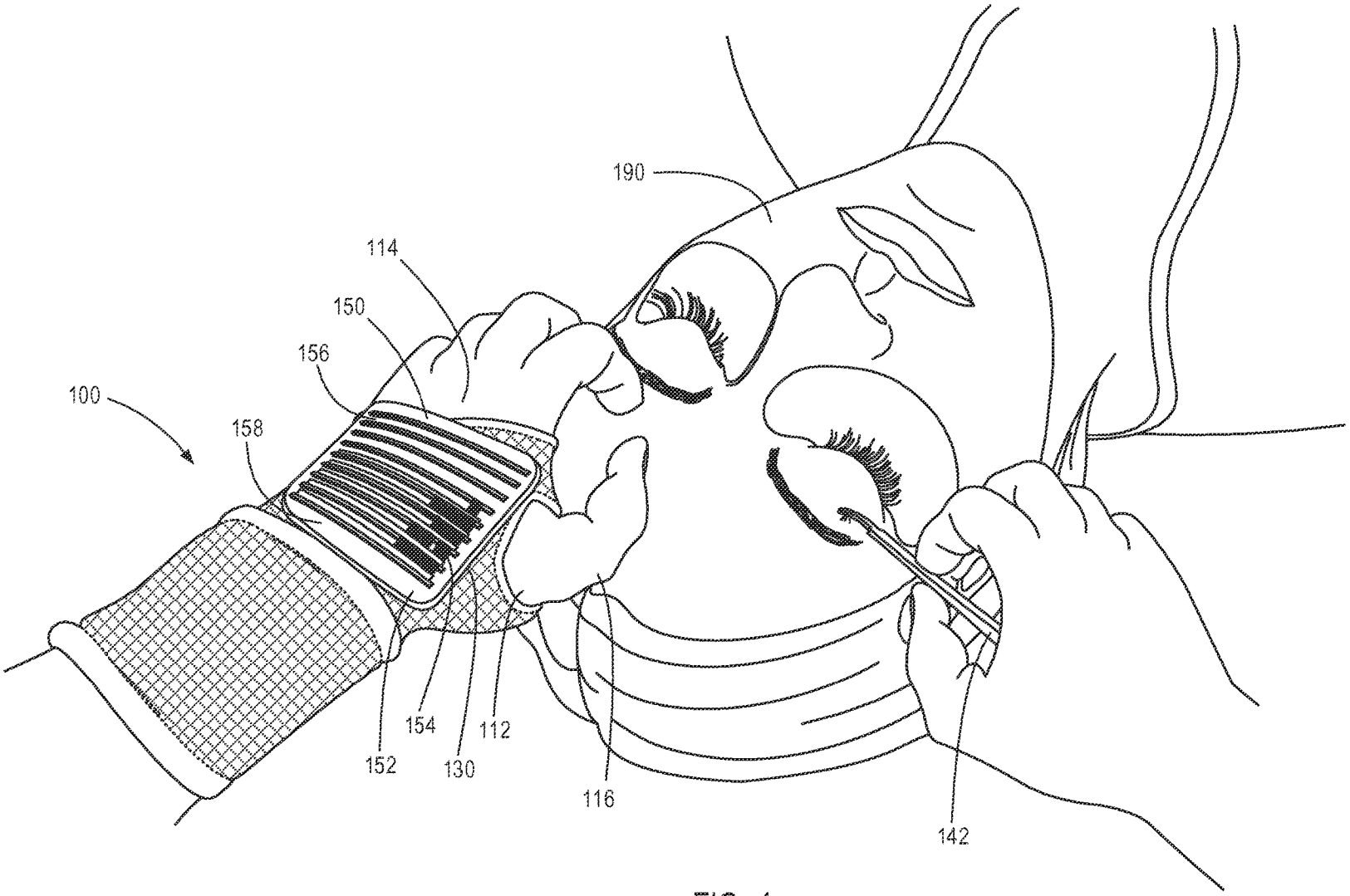
FIG. 4 is a perspective view of a user employing the esthetic apparatus of FIG. 1, also depicting a palette coupled to the esthetic apparatus, according to another embodiment of the present disclosure.

FIG. 4 depicts a user employing the esthetic apparatus 50 during the application of an esthetic product to a person (or "client") 190. The esthetic apparatus 50 comprises an elongate member 100 having a palette 150 coupled thereto. The palette 150 comprises a first surface 152 and a second surface (not shown). The first surface 152 is configured to receive, retain, and/or store an esthetic product 154. For example, the first surface 152 can comprise a smooth surface 156 upon which the esthetic product 154 can be coupled, and a support structure 158 to conveniently arrange the esthetic product 154. The second surface of the palette 150 can be coupled to the coupling region 130 of the esthetic apparatus 50.

As demonstrated in FIG. 4, some of the embodiments disclosed herein allow the user to hold and/or position the esthetic product 154 closer to the site of application on the client, thereby making the application of esthetic products 154 more convenient and potentially decreasing the amount of esthetic products 154 lost during an esthetic procedure. Additionally, by anchoring the esthetic apparatus 50 to the user's thumb 116, and coupling the palette 150 to the esthetic apparatus 50 via the coupling region 130, the user is able to control the position of the palette 150 by moving or rotating the user's hand 114 or wrist. In such embodiments, the user is able to stabilize the palette while keeping the user's fingers free for performing other tasks, particularly tasks associated with applying the esthetic product 154. Further, by anchoring the esthetic apparatus on the hand 114, wrist, or arm of the user, the esthetic apparatus 50 can be restricted from moving absent movement by the user. For example, the esthetic apparatus 50 and the palette 150 coupled thereto are not free to rotate independently about the user's hand, wrist, or arm.

By providing the user the ability to control the position of the palette by moving or rotating the user's hand, the user is able to move esthetic products on the palette to a position that is convenient for applying the esthetic products on a person. In such embodiments, the user may be able to save time and reduce dropping of the esthetic product during the user's reach from the palette to an application site on a person by moving the palette to a position that is closer to the application site. This control may also allow the user to easily move the palette away from the application site after picking up the esthetic product from the palette. In some embodiments, the control afforded to the user may allow the user to stabilize or balance the esthetic product on the palette, particularly during application.

In some embodiments, the palette 150 can be coupled to a coupling region 130 of the esthetic apparatus 50 that is disposed on or near the user's hand 114, as is shown in FIG. 4. In other embodiments, the palette 150 can be coupled to a coupling region 130 of the esthetic apparatus 50 that is disposed on or near the user's wrist. And in particular embodiments, the palette 150 may be coupled to a coupling region 130 disposed on or near the palm side of the wrist.

In some embodiments, the palette 150 comprises a flat surface upon which esthetic products 154 may be coupled. In other embodiments, the palette 150 may comprise a support surface or structure 158 that causes at least a portion of the esthetic product 154 to be suspended in the air thereby facilitating the removal of a portion of the esthetic product 154 from the palette 150. For example, if the esthetic product 154 were eyelash extensions, the support surface 158 may be a member that extends outwardly from the palette 150 causing at least a portion of the eyelash extensions to be displaced from the surface of the palette 150. Such a support surface or structure 158 can facilitate removal of one or more eyelash extensions with a tool such as tweezers. Coupling of the esthetic products 154 to the palette 150 may be accomplished via one or more of tape, adhesive, a clip, or other coupling member.

Figure 5B:
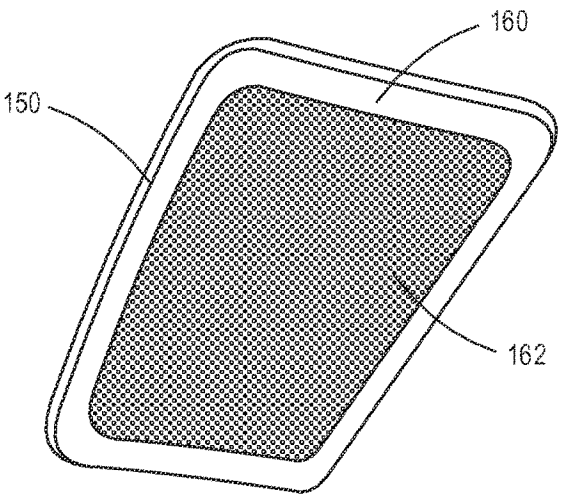
FIG. 5B is a perspective view of a second surface of the palette of FIG. 5A.
Figure 5A:
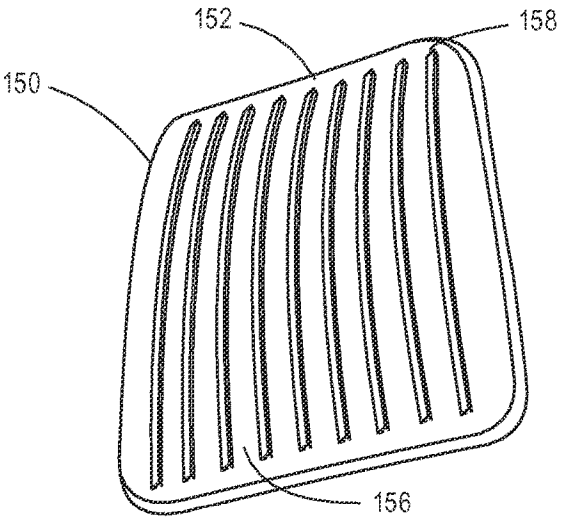
FIG. 5A is a perspective view of a first surface of a palette for use with an esthetic apparatus, according to another embodiment of the present disclosure.
Figure 5C:
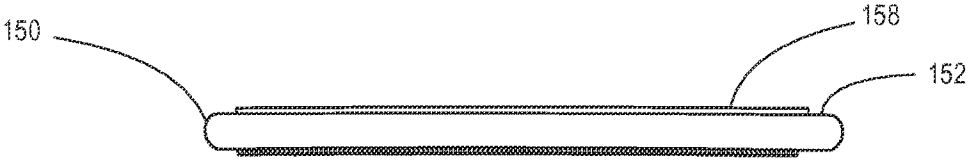
FIG. 5C is an end view of the palette of FIG. 5A.
Figure 5D:
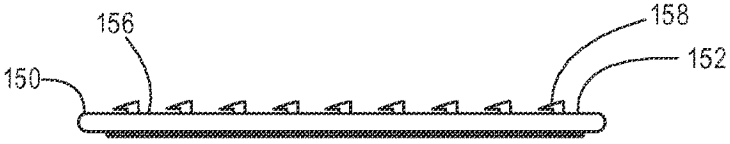
FIG. 5D is a side view of the palette of FIG. 5A.
Figure 5F:
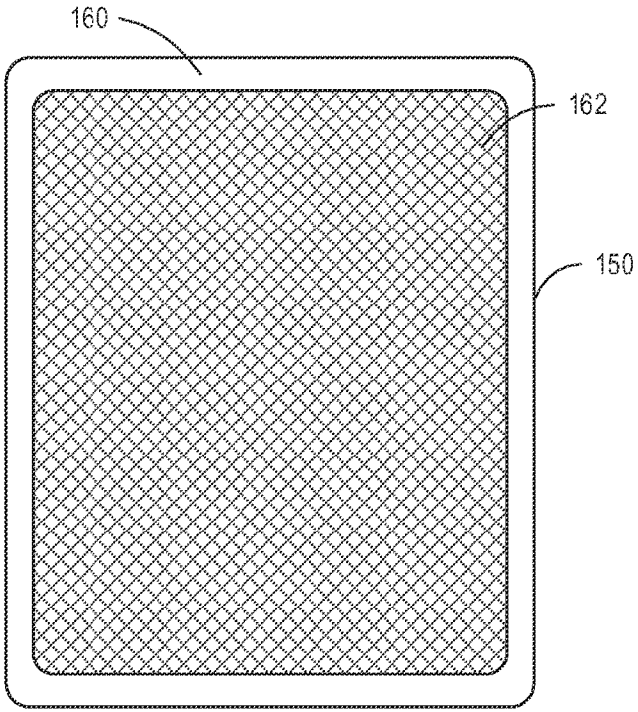
FIG. 5F is a bottom view of the palette of FIG. 5A.
Figure 5E:
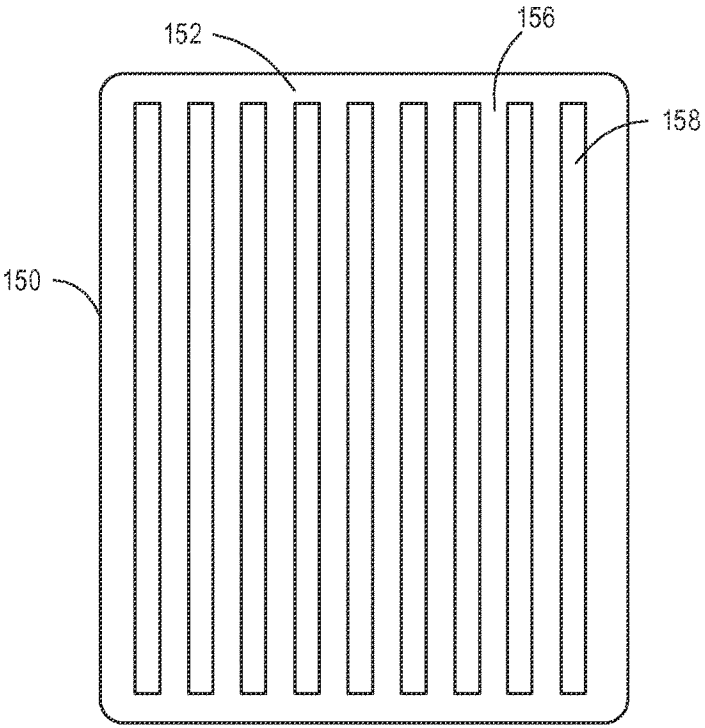
FIG. 5E is a top view of the palette of FIG. 5A.

FIG. 5A is a perspective view of the palette 150 showing the first surface 152, the smooth surface 156, and the support structure 158. FIG. 5B is a perspective view of the palette 150 showing the second surface 160 comprising a coupling member 162. FIG. 5C is an end view of the palette 150 showing the support structure 158 extending outwardly from the first surface 152. FIG. 5D is a side view of the palette 150 showing a plurality of support structures 158 extending outwardly from the first surface 152 with the smooth surface 156 extending between individual support structure elements 158. FIG. 5E is a top view of the palette 150 showing the first surface 152 of the palette 150. FIG. 5F is a bottom view of the palette 150 showing the second surface 160 of the palette 150.

The coupling member 162 of the palette 150 can be configured to couple to the coupling region of the elongate member 100. The coupling member 162 may comprise any variety of adhesives or fasteners (or components thereof), such as clips, snaps, ties, buckles, hooks, snaps, hook and loop fasteners, hook and hook fasteners, etc. In some embodiments, the coupling member 162 cooperates with the coupling region of the elongate member to engage or otherwise attach thereto (e.g., via hook and loop fasteners, and hook and hook fasteners). For example, one or more fastener components of the coupling member 162 can be configured to engage with one or more fastener components disposed on the coupling region.

Figure 6:
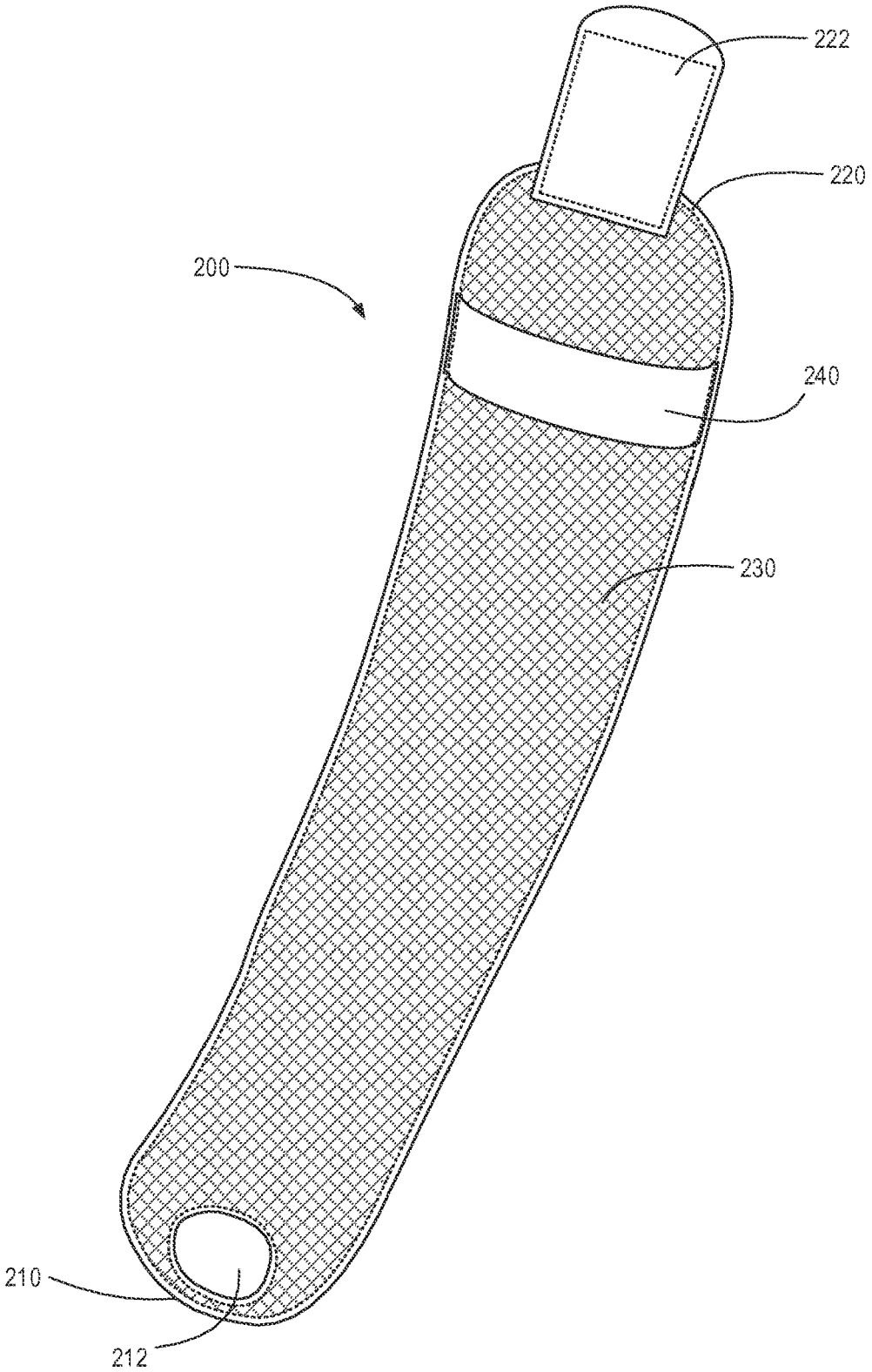
FIG. 6 is a perspective view of another esthetic apparatus in an unwrapped configuration, according to another embodiment of the present disclosure.

FIG. 6 depicts another embodiment of an esthetic apparatus 55. The esthetic apparatus 55 comprises an elongate member 200 having a first longitudinal end 210 and a second longitudinal end 220, an aperture or digit hole 212, an attachment member 222, and a coupling region 230, each of which can correspond to elements of the esthetic apparatus 50 of FIG. 1. The esthetic apparatus 55 of FIG. 6 further comprises a retaining member 240 for retaining tools for use in applying esthetic products.

As depicted in FIG. 6, the retaining member 240 may comprise a strap that forms a loop with the elongate member 200. Tools may be inserted partially or fully through the loop to attach to the elongate member 200. In other embodiments, the retaining member 240 may comprise a magnet upon which tools may be attached. In some embodiments, the retaining member 240 may comprise a plurality of loops for receiving and holding esthetic tools. In additional embodiments, the retaining member 240 may be a pocket for holding esthetic tools.

Figure 7:
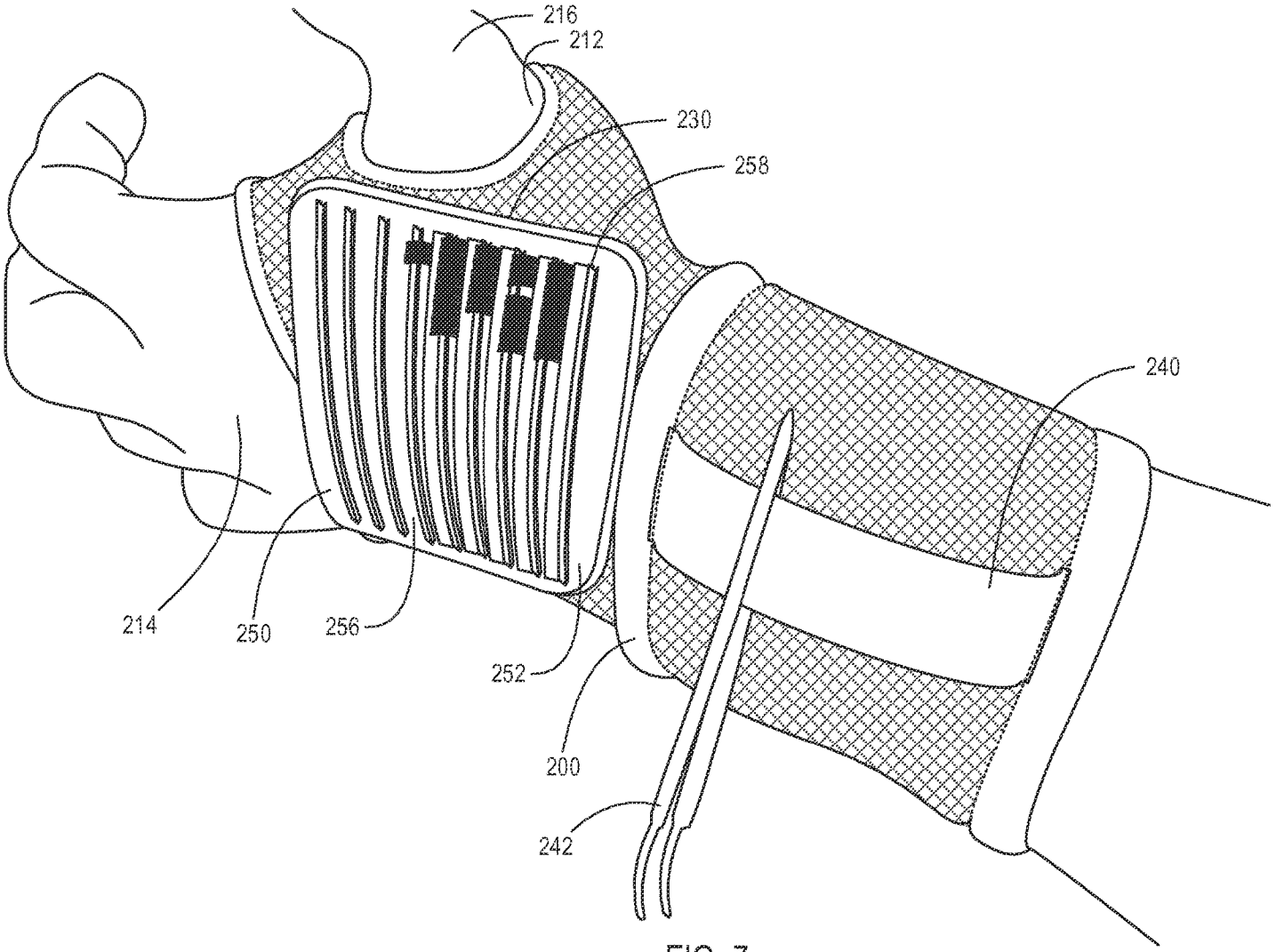
FIG. 7 is a perspective view of the esthetic apparatus of FIG. 6 in a wrapped configuration, also depicting a palette coupled to the esthetic apparatus.

FIG. 7 depicts the esthetic apparatus 55 of FIG. 6 wrapped around at least a portion of the user's hand 214, wrist, and arm in preparation for use in applying an esthetic product 254 to a client. The aperture or digit hole 212 is shown around a user's thumb 216, and the elongate member 200 is shown extending around the back of the user's hand 214 and around the user's wrist. A portion of the coupling region 230 of the elongate member 150 is disposed on the back of the user's hand 214 and a palette 250 is coupled thereto. The palette 250 comprises a first surface 252, a smooth surface 256, and a support structure 258. These elements of the palette 250 correspond to similar elements of palette 150 of FIGS. 5A-5F. FIG. 7 also shows a retaining member 240 that is retaining a tool 242 for applying esthetic products.

FIG. 8 is another embodiment of an esthetic apparatus 60. The esthetic apparatus 60 includes an elongate member 300 having an anchoring member comprising a first anchoring segment 310 and a second anchoring segment 311 that may be used to form and aperture or digit hole. The first anchoring segment 310 of the elongate member 300 is disposed between the thumb 316 and fingers of the user's hand. The second anchoring segment 311 of the elongate member 300 is disposed between the thumb 316 of the user's hand and the user's wrist 318. The first anchoring segment 310 and the second anchoring segment 311 are configured to couple to each other via a connecting member 313 that may comprise any one or more fastener disclosed herein such as a hook and hook or hook and loop connection. When coupled together, the first anchoring segment 310 and the second anchoring segment 311 form an aperture or digit hole to anchor the elongate member 300 to the user's thumb 316. In other embodiments of an elongate member, a distal first longitudinal end and a proximal first longitudinal end couple together around, and anchor the elongate member to, a finger of a user's hand.

FIG. 9 is another embodiment of an esthetic apparatus 70. The esthetic apparatus 70 includes an elongate member 400 having an anchoring member comprising a first anchoring segment 410 and a second anchoring segment 411 that may be used to form and aperture or digit hole. The first anchoring segment 410 of the elongate member 400 is disposed between the thumb 416 and fingers of the user's hand. The second anchoring segment 411 of the elongate member 400 is disposed between the thumb 416 of the user's hand and the user's wrist 418. The first anchoring segment 410 and the second anchoring segment 411 are configured to couple to each other via a connecting member 413 that may comprise any type of fastener disclosed herein such as a such as a tie or crimp. When coupled together, the first anchoring segment 410 and the second anchoring segment 411 form an aperture or digit hole to anchor the elongate member 400 to the user's thumb 416. In other embodiments of an elongate member, a distal first longitudinal end and a proximal first longitudinal end couple together around, and anchor the elongate member to, a finger of a user's hand.

In other embodiments, the esthetic apparatus can be in the form of a bracelet, a band, a glove, or a brace. And in yet another embodiment, the esthetic apparatus can comprise an elongate member having one or more attachment members on its latitudinal side or sides, and the elongate member can be wrapped around at least a portion of the user's hand, wrist, or arm using the one or more attachment members to couple one latitudinal side with the other latitudinal side to maintain a wrapped configuration of the elongate member.

Methods of using the disclosed esthetic apparatus are also disclosed herein. In particular, it is contemplated that any of the components, principles, and/or embodiments discussed above may be utilized in either an esthetic apparatus or a method of using the same. For example, in an embodiment, a method of using the esthetic apparatus can comprise a step of wrapping an esthetic apparatus, as described herein, around one or more of a hand, wrist, and arm of a user. The method may further comprise coupling a palette, as described herein, to the coupling region of an elongate member of the esthetic apparatus. The method may further comprise using the esthetic apparatus in applying an esthetic product to a person. In some embodiments of the method, the elongate member further comprises an anchor, such as a digit hole, adjacent the first longitudinal end of the elongate member for placement of the elongate member around a digit of the user's hand. In some of these embodiments of the method, the digit hole is configured to be placed around the thumb of the user's hand, permitting the thumb to stabilize the elongate member and thus restrict rotation of the palette independent from movement of the user's hand. In some embodiments of the method, the user forms the aperture or digit hole by wrapping portions of the esthetic apparatus around a digit of the user's hand. In some embodiments of the method, the user attaches two components of the esthetic apparatus to form an aperture or digit hole.

Although eyelash extensions are used herein as an exemplary esthetic product, it is within the scope of this disclosure that other esthetic products can be used with the esthetic apparatus disclosed herein including, but not limited to, make-up, lotion, artificial nails, nail polish, and oils.

Various modifications, changes, and variations apparent to those of skill in the art may be made in the arrangement, operation, and details of the disclosed embodiments without departing from the spirit and scope of the disclosure. Thus, it is to be understood that the embodiments described above have been presented by way of example, and not limitation.

Unless defined otherwise, all technical and scientific terms used herein have the same meaning as commonly understood by one of ordinary skill in the art to which the embodiments of the invention belong. Although any methods and materials similar or equivalent to those described herein can also be used in the practice or testing of the embodiments of the present invention, the preferred methods and materials are now described.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed embodiments of the present invention. Thus, it is intended that the scope of at least some of the present invention herein disclosed should not be limited by the particular disclosed embodiments described above.

It will be obvious to those having skill in the art that many changes may be made to the details of the above-described embodiments without departing from the underlying principles of the invention. The scope of the present invention should, therefore, be determined only by the following claims.

The invention claimed is:

1. An esthetic apparatus configured for use in applying eyelash extensions, the esthetic apparatus comprising:

a non-rigid elongate member comprising:

a first longitudinal end;

a second longitudinal end;

an interior surface extending from the first longitudinal end to the second longitudinal end;

an external surface opposite the interior surface, the external surface extending from the first longitudinal end to the second longitudinal end;

a digit hole defined through the interior surface and the external surface at the first longitudinal end, the digit hole positioned between substantially parallel latitudinal sides of the elongate member, and the digit hole configured for coupling the first longitudinal end of the elongate member to a user's hand; and a coupling region, comprising a first portion of one of a hook and hook fastener or a hook and loop fastener, between the digit hole and the second longitudinal end, the coupling region comprising substantially all of the external surface;

an attachment member extending longitudinally away from the second longitudinal end of the non-rigid elongate member, the attachment member configured to attach the second longitudinal end to a portion of the elongate member located between the first longitudinal end and the second longitudinal end;

a palette coupled to the coupling region comprising a first surface and a second surface, the first surface comprising a smooth surface and the second surface comprising a second portion of the one of the hook and hook fastener or the hook and loop fastener for coupling the palette to the coupling region of the elongate member; and eyelash extensions attached to the smooth surface of the first surface.

2. The esthetic apparatus of claim 1, wherein the first surface of the palette comprises a plurality of support structures extending from the smooth surface such that at least portions of the eyelash extensions received by the smooth surface are configured to be displaced from the smooth surface.

3. The esthetic apparatus of claim 2, wherein the plurality of support structures comprise a plurality of parallel elements extending from the smooth surface.

4. The esthetic apparatus of claim 2, wherein at least one of the plurality of support structures extend from an inner portion of the first surface.

5. The esthetic apparatus of claim 2, wherein one or more of the support structures comprise:

a stand including a first end and a second end, the first end coupled to the smooth surface; and a face coupled to the second end, the face sloped relative to the smooth surface.

6. The esthetic apparatus of claim 2, wherein one or more of the support structures comprise a wedge portion, wherein the wedge portion has a face that is sloped relative to the smooth surface to form an acute angle with the smooth surface.

7. The esthetic apparatus of claim 2, wherein the plurality of support structures are integrated in the palette.

8. The esthetic apparatus of claim 1, wherein the elongate member further comprises a retaining member for retaining tools for applying the eyelash extensions.

9. The esthetic apparatus of claim 8, wherein the retaining member comprises a band forming a loop with the elongate member through which a tool for applying the eyelash extensions is secured to the elongate member.

10. The esthetic apparatus of claim 1, wherein the elongate member includes only two latitudinal sides extending between the first longitudinal end and the second longitudinal end.

11. A method of using an esthetic apparatus for applying eyelash extensions, the method comprising:

removing an eyelash extension from the esthetic apparatus, the esthetic apparatus comprising:

a non-rigid elongate member comprising:

a first longitudinal end;

a second longitudinal end;

an interior surface extending from the first longitudinal end to the second longitudinal end;

an external surface opposite the interior surface, the external surface extending from the first longitudinal end to the second longitudinal end;

a digit hole defined through the interior surface and the external surface at the first longitudinal end, the digit hole positioned between substantially parallel latitudinal sides of the elongate member, and the digit hole configured for coupling the first longitudinal end of the elongate member to a user's hand; and a coupling region, comprising a first portion of one of a hook and hook fastener or a hook and loop fastener, between the digit hole and the second longitudinal end, the coupling region comprising substantially all of the external surface;

an attachment member extending longitudinally away from the second longitudinal end of the non-rigid elongate member, the attachment member configured to attach the second longitudinal end to a portion of the elongate member located between the first longitudinal end and the second longitudinal end;

a palette coupled to the coupling region comprising a first surface and a second surface, the first surface comprising a smooth surface and the second surface comprising a second portion of the one of the hook and hook fastener or the hook and hook fastener for coupling the palette to the coupling region of the elongate member; and eyelash extensions attached to the smooth surface of the first surface; and applying the eyelash extension to a person.

12. The method of claim 11, wherein the first surface of the palette comprises a plurality of support structures extending from the smooth surface such that at least portions of the eyelash extensions received by the smooth surface are configured to be displaced from the smooth surface.

13. The method of claim 12, wherein the plurality of support structures comprise a plurality of parallel elements extending from the smooth surface.

14. The method of claim 12, wherein at least one of the plurality of support structures extend from an inner portion of the first surface.

15. The method of claim 12, wherein one or more of the support structures comprise:

a stand including a first end and a second end, the first end coupled to the smooth surface; and a face coupled to the second end, the face sloped relative to the smooth surface.

16. The method of claim 12, wherein one or more of the support structures comprise a wedge portion, wherein the wedge portion has a face that is sloped relative to the smooth surface to form an acute angle with the smooth surface.

17. The method of claim 12, wherein the plurality of support structures are integrated in the palette.

18. The method of claim 11, wherein the elongate member further comprises a retaining member for retaining tools for applying the eyelash extensions.

19. The method of claim 18, wherein the retaining member comprises a band forming a loop with the elongate member through which a tool for applying the eyelash extensions is secured to the elongate member.

20. The method of claim 11, wherein the elongate member includes only two latitudinal sides extending between the first longitudinal end and the second longitudinal end.

* * * * *